US011077537B2

(12) United States Patent
Niles

(10) Patent No.: US 11,077,537 B2
(45) Date of Patent: Aug. 3, 2021

(54) ADJUSTABLE CHAIN WRENCH AND METHOD OF USE

(71) Applicant: Clair D. Niles, Ottawa, KS (US)

(72) Inventor: Clair D. Niles, Ottawa, KS (US)

( * ) Notice: Subject to any disclaimer, the term of this patent is extended or adjusted under 35 U.S.C. 154(b) by 240 days.

(21) Appl. No.: 16/273,571

(22) Filed: Feb. 12, 2019

(65) Prior Publication Data

US 2020/0254591 A1 Aug. 13, 2020

(51) Int. Cl.
*B25B 13/52* (2006.01)
*B25B 23/16* (2006.01)

(52) U.S. Cl.
CPC ..... *B25B 13/52* (2013.01); *B25B 23/16* (2013.01)

(58) Field of Classification Search
CPC ..... B25B 13/52; B25B 13/54; B25B 13/56; B25B 23/16; B25B 27/0042; B25B 13/04; B25B 13/481; B25B 9/00; B25B 5/14
See application file for complete search history.

(56) References Cited

U.S. PATENT DOCUMENTS 1,413,306 A * 4/1922 William ..... B25B 13/52 81/65.4
2,825,253 A * 3/1958 Brenner ..... B25B 13/463 81/68
3,288,001 A * 11/1966 Laird, Jr. ..... B25B 13/52 81/68
3,752,016 A * 8/1973 Ballard ..... B25B 13/52 81/64
4,138,910 A * 2/1979 Laird, Jr. ..... B25B 13/52 81/65.2
4,171,652 A 10/1979 Curry
5,320,021 A * 6/1994 Heintz ..... B25B 13/52 81/177.2
5,494,268 A * 2/1996 Heintz ..... B25B 13/52 269/130
6,427,562 B1 8/2002 Muhlenkort
2007/0051211 A1 3/2007 Stewart et al.

FOREIGN PATENT DOCUMENTS

GB 23580 12/1904

* cited by examiner

*Primary Examiner* — Robert J Scruggs
(74) *Attorney, Agent, or Firm* — Law Office of Mark Brown, LLC; Christopher M. DeBacker

(57) ABSTRACT

A chain wrench which utilizes ordinary high-speed drive chain to form an adjustable, replaceable chain wrench of unlimited length potential. A sprocket for gripping at the head of the wrench, and allows the chain to nearly completely wrap about the object to be turned or held, preventing the need for a gripping portion which tends to damage or crush the object being turned or held. Multiple such chains could be used simultaneously.

9 Claims, 5 Drawing Sheets

ADJUSTABLE CHAIN WRENCH AND METHOD OF USE

BACKGROUND OF THE INVENTION

1. Field of the Invention

The present invention relates generally to a chain wrench and method for use thereof, and more specifically to an adjustable chain wrench utilizing ordinary high-speed chain.

2. Description of the Related Art

Chain wrenches are used to hold or turn smooth objects, typically with a circular cross section such as a pipe section. Typical chain wrenches are of a limited length and often employ a gripping element for securing the chain to the object, but which tends to crush or mar the surface. What is needed is a chain wrench solution with unlimited length potential and the ability to completely grip the object with the chain without damaging or crushing the object.

Heretofore there has not been available a system or method for an adjustable chain wrench with the advantages and features of the present invention.

BRIEF SUMMARY OF THE INVENTION

The present invention generally provides a chain wrench which utilizes ordinary high-speed drive chain, which can be easily acquired at any hardware store, to form an adjustable, replaceable chain wrench of unlimited length potential. It utilizes a sprocket for gripping at the head of the wrench, and allows the chain to nearly completely wrap about the object to be turned or held, preventing the need for a gripping portion which tends to damage or crush the object being turned or held.

Multiple such chains could be employed. A preferred embodiment has one or two chains, but additional chains could also be connected and used for superior grip on the body to be held or turned. A pivoting pair of arms holds a roller which allows for the chain(s) to be fed back around and over the sprocket(s) to tighten and secure the chain(s) about the body.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
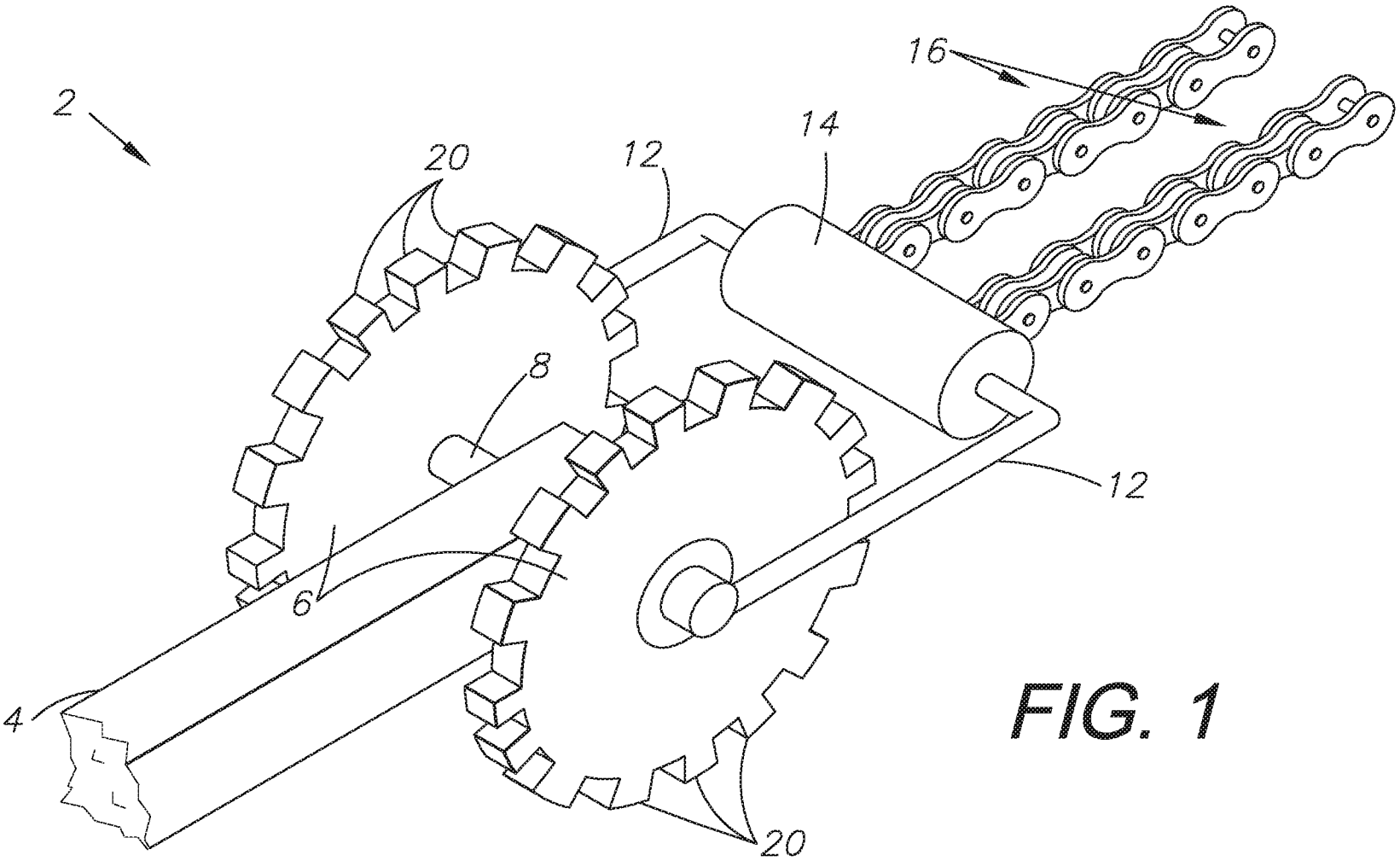
FIG. 1 is a three-dimensional isometric view of an embodiment of the present invention showing two chains.
Figure 2:
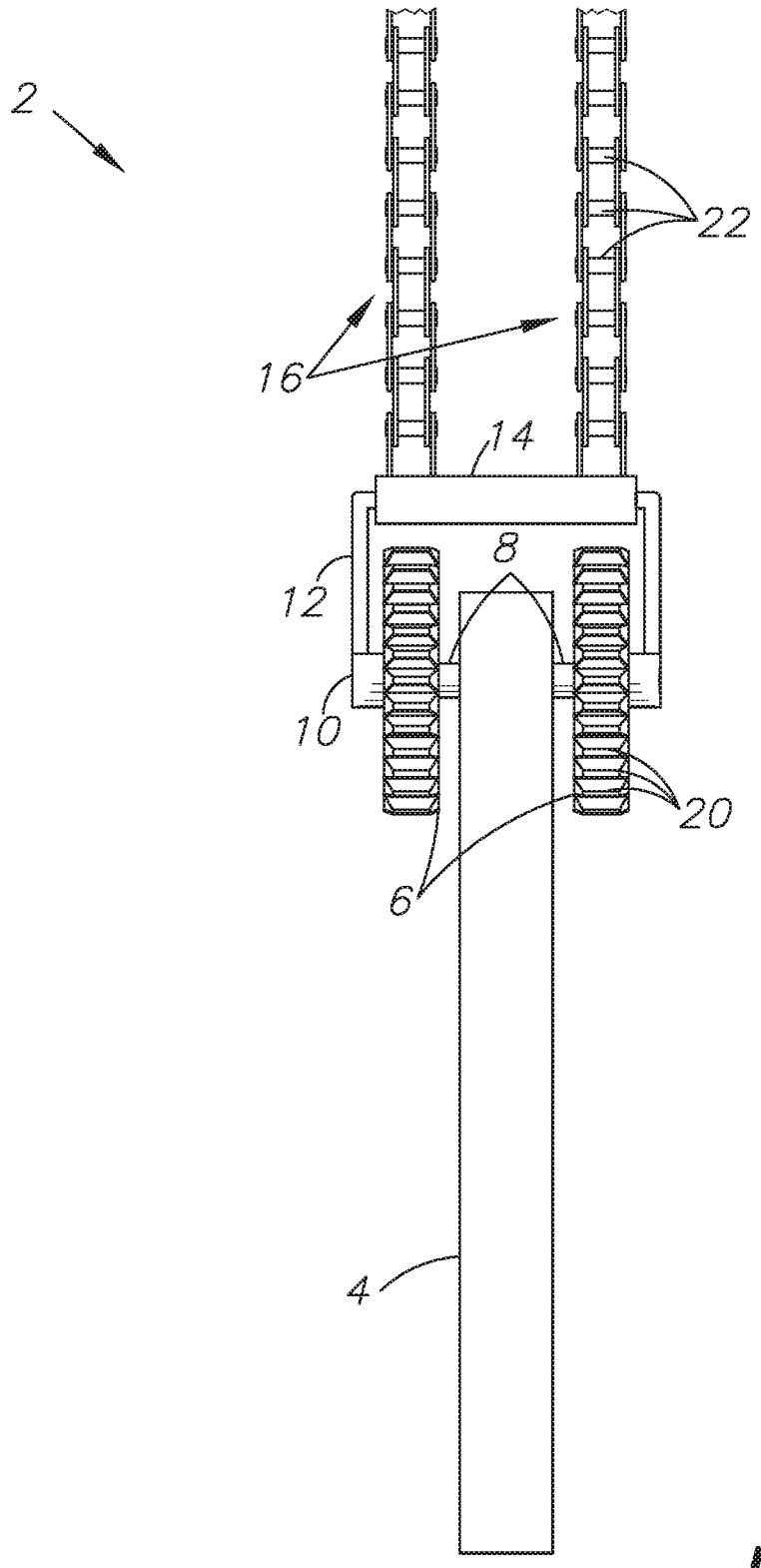
FIG. 2 is a top plan view thereof.
Figure 3:
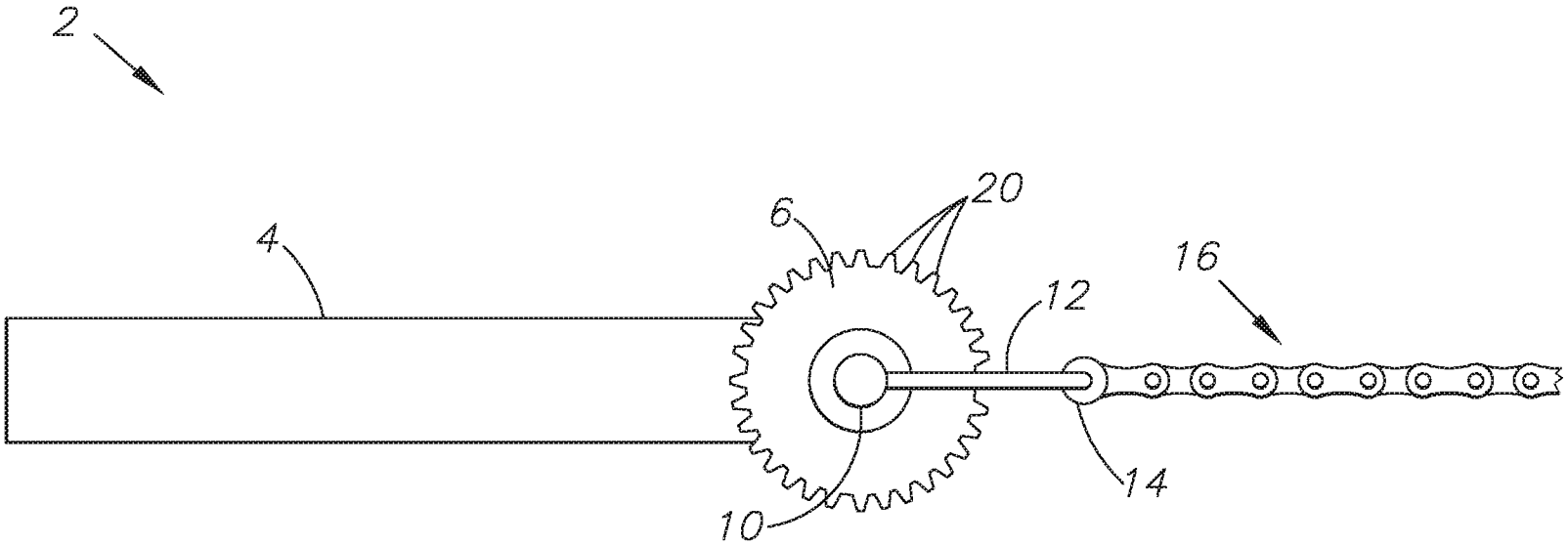
FIG. 3 is a side elevational view thereof.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Chain Wrench 2

As shown in the figures, the present invention provides a chain wrench 2 for gripping a body 18, such as a pipe or preferably some other body having a circular cross section. It could also be used for bodies of other cross sections, but is designed particularly for those bodies having a circular cross section as shown in FIGS. 4 and 5.

A wrench handle 4 with one end forming a grip ends in a wrench end including a sprocket 6, or two as shown, connected by a pin 8 to the wrench handle 4. The pin 8 and sprocket 6 are affixed solidly to the handle 4 and do not move relative to one another, which allows the sprocket to tighten the chain 16 about the body 18. A pivot arm 12 extends from each sprocket 6 via a rotatable pivot point 10. As shown, the two pivot arms 12 connect to a chain connector 14 which connects to chains 16 as shown. Multiple chains 16 could be attached, or a single chain. A preferred embodiment includes at least two chains, but a single chain would still function to create a superior chain wrench 2 compared with the prior art.

Figure 4:
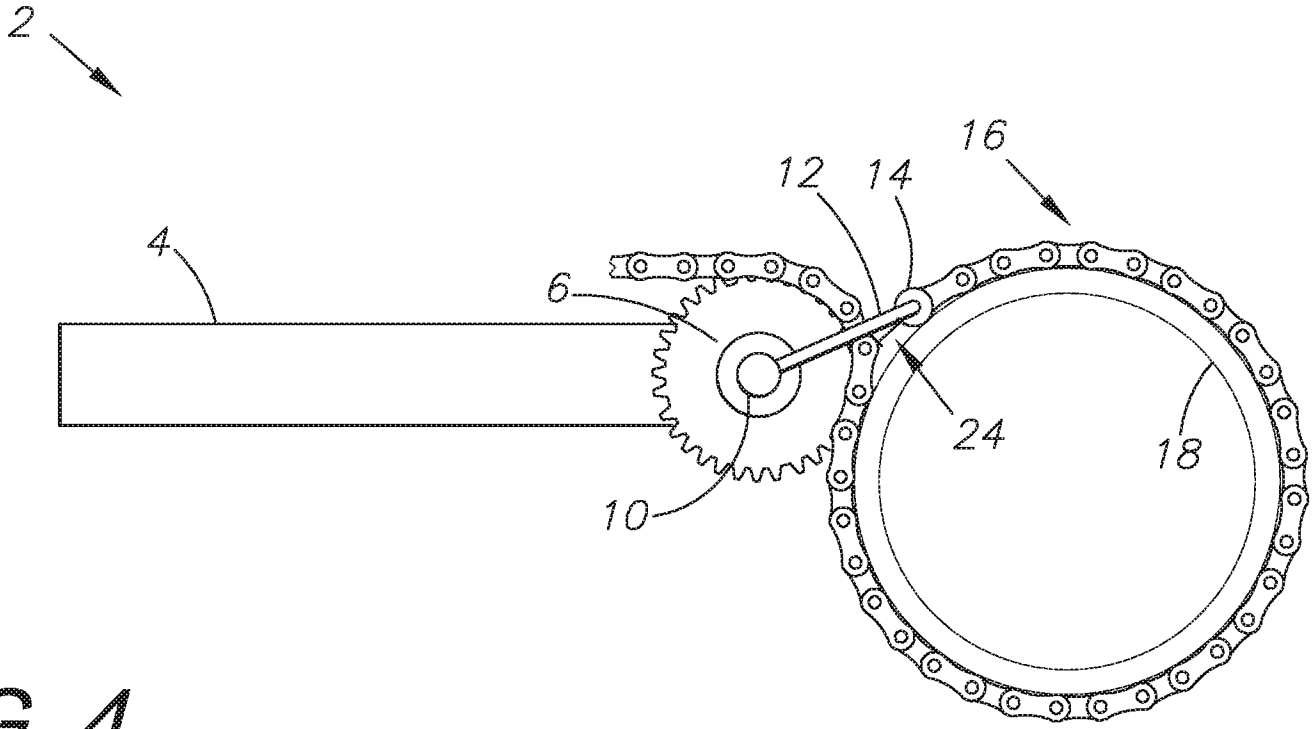
FIG. 4 is a side elevational view thereof shown engaged with a typical environment.
Figure 5:
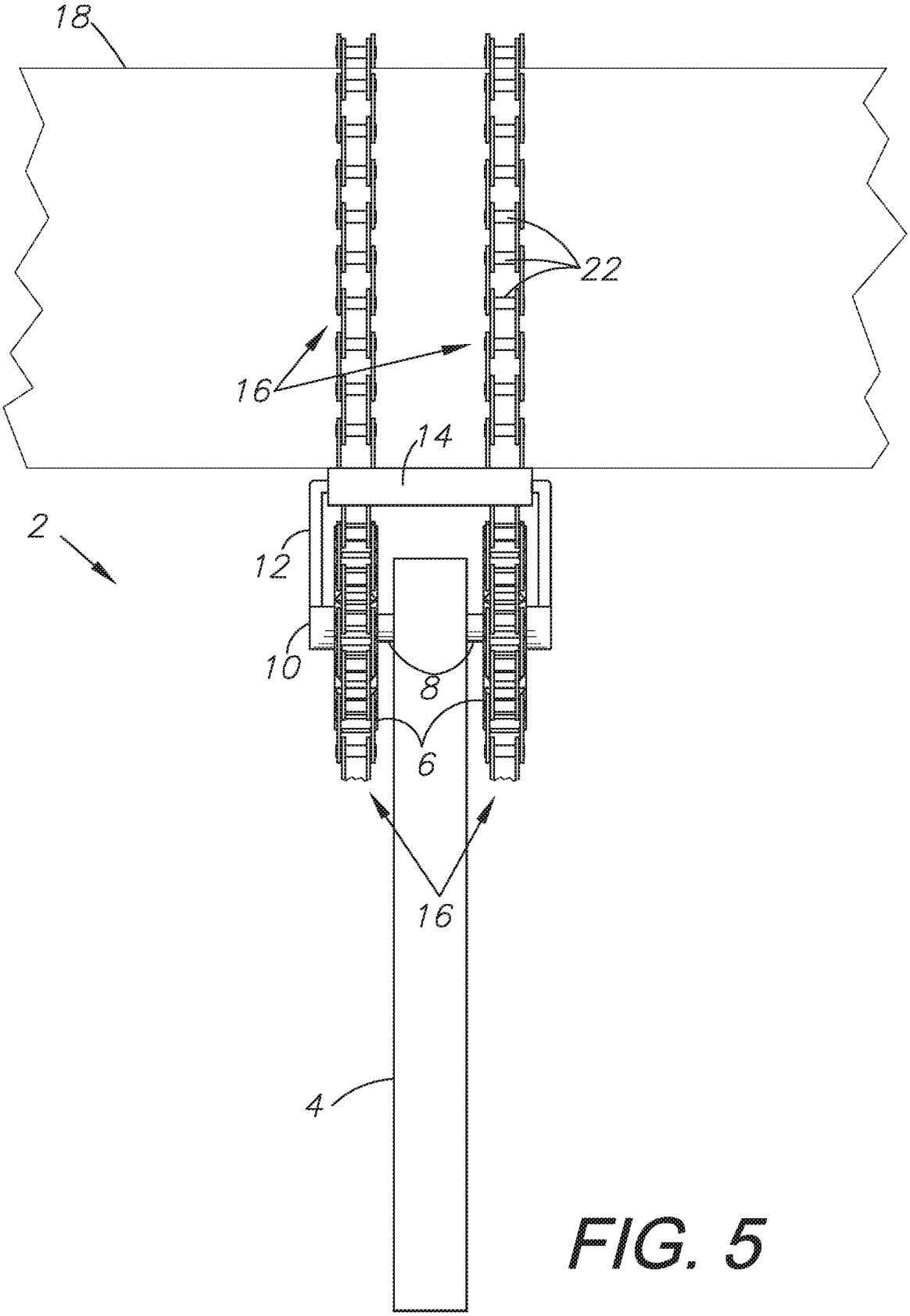
FIG. 5 is a top plan view thereof shown engaged with a typical environment.

As show in FIGS. 4 and 5, the chain wrench 2 wraps the chains 16 about a body 18, such as a pipe or other object. This works best with a body 18 having a circular cross section, but could be used for bodies of most shapes. After the chains 16 are wrapped about the body 18, the links 22 of the chain 16 are received within the teeth 20 of the sprockets 6. This allows the chains to be securely locked into place about the body 18 such that a minimal gap 24 is formed between the chain connector 14 and the entirety of the chain 16 wrapping about the body 18, such that the body is almost entirely encompassed by the chain, forming a superior grip about the body and allowing it to be held in place or turned as desired. There is almost no way for the chain to slip about the body 18, forming a superior connection.

The pivot arms 12 can pivot about the rotatable pivot points 10 of the sprockets 6, and the chain connector 14 can rotate about the ends of the pivot arms 12, allowing for near-complete coverage of the body 18.

When the chain(s) 16 are wrapped around the body 18, they follow a perimeter around the body 18, which would be a circumference for a cylindrical body having a circular cross section. For bodies having a non-circular cross section, the perimeter simply follows the chain around the body along each side of the body. When completely wrapped about the perimeter and back over the sprocket 6, the chain 16 covers at least 90% of the total perimeter around the body.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A chain wrench comprising:

a handle with a gripping end and a wrench end;

said wrench end comprising a first sprocket connected to said wrench end via a first pin, said pin fixing said first sprocket about said wrench end;

a first pivot arm pivotally connected to said first sprocket, said first pivot arm ending in a chain connector;

a first chain comprising a high speed chain of a first length having a first end affixed to said chain connector and a second end extending away from said chain connector;

said first chain configured to be wrapped about a body, such that said second end of said first chain is wrapped about said body and placed over said first sprocket;

said first sprocket and first chain are radially spaced from a first side of said handle;

a second sprocket connected to said wrench end via a second pin, said second pin fixing said second sprocket about said wrench end;

a second pivot arm pivotally connected to said second sprocket, said second pivot arm ending at said chain connector;

a second chain comprising a high-speed chain of a second length having a first end affixed to said chain connector and a second end extending away from said chain connector;

said second chain configured to be wrapped about said body, such that said second end of said second chain is wrapped about said body and placed over said second sprocket;

said second sprocket and second chain are radially spaced from a second side of said handle, said second side of said handle being opposite to said first side;

whereby said first chain is tightened about said body, such that said second chain wraps a perimeter comprising at least 90% of a perimeter of said body; and whereby said first chain is tightened about said body, such that said first chain wraps a perimeter comprising at least 90% of a perimeter of said body.

2. The chain wrench of claim 1, further comprising:

said sprocket configured to tighten said chain about said body by rotating said handle while chain lengths of said chain are received within teeth of said sprocket.

3. The chain wrench of claim 1, wherein said body comprises a circular cross section.

4. The chain wrench of claim 1, further comprising:

said first chain configured to be disconnected from said chain connector; and a second chain configured to be connected in place of said first chain, wherein said second chain comprising a high speed chain of a second length having a first end affixed to said chain connector and a second end extending away from said chain connector; and whereby said second chain is tightened about said body, such that said second chain wraps a perimeter comprising at least 90% of a perimeter of said body.

5. A chain wrench comprising:

a handle with a gripping end and a wrench end;

said wrench end comprising a first sprocket connected to said wrench end via a first pin, said first pin fixing said first sprocket about said wrench end;

said wrench end further comprising a second sprocket connected to said wrench end via a second pin, said second pin fixing said second sprocket about said wrench end;

a first pivot arm pivotally connected to said first sprocket, said first pivot arm ending in a chain connector;

a second pivot arm pivotally connected to said second sprocket, said second pivot arm ending in said chain connector;

a first chain comprising a high speed chain of a first length having a first end affixed to said chain connector and a second end extending away from said chain connector;

said first chain configured to be wrapped about a body, such that said second end of said first chain is wrapped about said body, under said chain connector, and placed over said first sprocket;

a second chain comprising a high speed chain of a first length having a first end affixed to said chain connector and a second end extending away from said chain connector;

said second chain configured to be wrapped about a body, such that said second end of said second chain is wrapped about said body, under said chain connector, and placed over said second sprocket;

said first sprocket and first chain are radially spaced from a first side of said handle;

said second sprocket and second chain are radially spaced from a second side of said handle, said second side of said handle being opposite to said first side; and whereby said first chain is tightened about said body, such that said first chain wraps a perimeter comprising at least 90% of a first circumference of said body and said second chain is tightened about said body, such that said second chain wraps a perimeter comprising at least 90% of a second circumference about said body.

6. The chain wrench of claim 5, further comprising:

said first and second chains configured to be disconnected from said chain connector;

a third chain and a fourth chain each being of a second length and each configured to be connected to said chain connector to replace a respective one of said first and second chains; and wherein said second length differs from said first length.

7. A method of turning a body with a chain wrench, the method comprising the steps:

wrapping a first chain about a body, said first chain having a first end connected to a chain connector and a second end being free;

wrapping said first chain second end around said body, under said chain connector, and onto a first sprocket such that said first chain contacts at least 90% of a perimeter about said body, said first sprocket being connected to said chain connector via a first pivot arm;

linking links of said first chain into teeth of said first sprocket and tightening said first chain about said body;

rotating a handle connected to said sprocket, pivot arm, and chain connector such that said first chain further tightens about said body;

wrapping a second chain about said body, said second chain having a first end connected to said chain connector and a second end being free;

wrapping said second chain second end around said body, under said chain connector, and onto a second sprocket such that said second chain contacts at least 90% of a perimeter about said body, said second sprocket being connected to said chain connector via a second pivot arm;

linking links of said second chain into teeth of said second sprocket and tightening said second chain about said body;

wherein said first sprocket and first chain are radially spaced from a first side of said handle;

wherein said second sprocket and second chain are radially spaced from a second side of said handle, said second side of said handle being opposite to said first side; and rotating said body by rotating said handle as said first chain grips said body.

8. The method of claim 7, further comprising the steps:

disconnecting said first chain from said chain connector;

connecting a second chain to said chain connector;

wherein said first chain is of a first length; and wherein said second chain is a of a second length, said second length different from said first length.

9. The method of claim 7, wherein said first chain comprises a standard high speed chain.

* * * * *